US007992808B2

(12) United States Patent
Micheli

(10) Patent No.: US 7,992,808 B2
(45) **Date of Patent: *Aug. 9, 2011**

(54) FLUID ATOMIZING SYSTEM AND METHOD

(75) Inventor: Paul R. Micheli, Glen Ellyn, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/561,259

(22) Filed: Sep. 16, 2009

(65) Prior Publication Data

US 2010/0006673 A1 Jan. 14, 2010

Related U.S. Application Data

(63) Continuation of application No. 11/445,076, filed on May 31, 2006, now Pat. No. 7,883,026, which is a continuation-in-part of application No. 10/880,653, filed on Jun. 30, 2004, now Pat. No. 7,926,733.

(51) Int. Cl.
*B05B 1/34* (2006.01)

(52) U.S. Cl. ..... 239/487; 239/417.3; 239/424; 239/424.5; 239/433; 239/470; 239/500; 239/525; 239/518; 239/456; 239/414

(58) Field of Classification Search ..... 239/290, 239/296, 298, 299, 414, 417.3, 423, 424, 239/424.5, 425, 433, 469, 470, 451, 456, 239/474, 483, 487, 488, 490, 494, 500, 501, 239/518, 521, 522, 525, 526, 537–539
See application file for complete search history.

(56) References Cited

U.S. PATENT DOCUMENTS

| | | | |
|---|---|---|---|
| 1,650,128 | A | 11/1927 | Hubbard |
| 1,741,169 | A | 12/1929 | Thompson |
| 2,246,211 | A | 6/1941 | Kilich |
| 2,303,280 | A | 11/1942 | Jenkins |
| 2,307,014 | A | 1/1943 | Becker et al. |
| 2,435,605 | A | 2/1948 | Rowell |
| 2,595,759 | A | 5/1952 | Buckland et al. |
| 2,895,685 | A | 7/1959 | Peeps |
| 2,993,655 | A | 7/1961 | Obrien |

(Continued)

FOREIGN PATENT DOCUMENTS

EP 0630690 12/1994

(Continued)

OTHER PUBLICATIONS

Spanogle et al; Development of an Impinging-Jet Fuel-Injection Valve Nozzle; National Advisory Committee for Aeronautics: Technical Note No. 372, 1931.

*Primary Examiner* — Steven J Ganey
(74) *Attorney, Agent, or Firm* — Fletcher Yoder

(57) ABSTRACT

In accordance with certain embodiments, a system includes a spray device having a liquid pathway leading to a liquid exit, an air pathway leading to an air exit directed toward a spray region downstream of the liquid exit, and an assembly disposed in the liquid pathway adjacent the liquid exit. The assembly includes a threadless pintle generally fit into a sleeve in a concentric manner without threads. The assembly also includes a generally annular passage between the threadless pintle and the sleeve and a passage coupled with the generally annular passage. The generally annular passage also has a cross-sectional area that alternatingly increases and decreases in a lengthwise direction along the liquid pathway.

20 Claims, 12 Drawing Sheets

U.S. PATENT DOCUMENTS

| | | | |
|---|---|---|---|
| 3,032,277 | A | 5/1962 | Petty |
| 3,100,084 | A | 8/1963 | Biber |
| 3,130,910 | A | 4/1964 | Sill |
| 3,190,564 | A | 6/1965 | Liedberg |
| 3,344,558 | A | 10/1967 | Kirkland |
| 3,521,824 | A | 7/1970 | Wilcox |
| 3,734,406 | A | 5/1973 | Runstadler et al. |
| 3,746,253 | A | 7/1973 | Walberg |
| 3,747,851 | A | 7/1973 | Conrad |
| 3,857,511 | A | 12/1974 | Govindan |
| 3,907,202 | A | 9/1975 | Binoche |
| 3,946,947 | A | 3/1976 | Schneider |
| 4,159,082 | A | 6/1979 | Luderer et al. |
| 4,260,110 | A | 4/1981 | Werding |
| 4,330,086 | A | 5/1982 | Nysted |
| 4,406,407 | A | 9/1983 | Aprea et al. |
| 4,485,968 | A | 12/1984 | Berthiaume |
| 4,520,962 | A | 6/1985 | Momono et al. |
| 4,632,314 | A | 12/1986 | Smith et al. |
| 4,646,968 | A | 3/1987 | Sablatura |
| 4,767,057 | A | 8/1988 | Degli et al. |
| 4,899,937 | A | 2/1990 | Haruch |
| 4,909,443 | A | 3/1990 | Takagi |
| 4,998,672 | A | 3/1991 | Bordaz et al. |
| 5,035,358 | A | 7/1991 | Katsuno et al. |
| 5,072,883 | A | 12/1991 | Vidusek |
| 5,074,466 | A | 12/1991 | Santiago |
| 5,106,025 | A | 4/1992 | Giroux et al. |
| 5,170,941 | A | 12/1992 | Morita et al. |
| 5,180,104 | A | 1/1993 | Mallette |
| 5,209,405 | A | 5/1993 | Robinson et al. |
| 5,249,746 | A | 10/1993 | Kaneko et al. |
| 5,273,059 | A | 12/1993 | Gross et al. |
| 5,319,568 | A | 6/1994 | Bezaire |
| 5,344,078 | A | 9/1994 | Fritz et al. |
| 5,358,182 | A | 10/1994 | Cappeau et al. |
| 5,419,491 | A | 5/1995 | Breitsprecher |
| 5,553,784 | A | 9/1996 | Theurer |
| 5,685,482 | A | 11/1997 | Sickles |
| 5,685,495 | A | 11/1997 | Pham et al. |
| 5,699,967 | A | 12/1997 | Conatser et al. |
| 5,899,387 | A | 5/1999 | Haruch |
| 6,021,962 | A | 2/2000 | Hedger |
| 6,045,057 | A | 4/2000 | Moor et al. |
| 6,085,996 | A | 7/2000 | Culbertson et al. |
| 6,129,295 | A | 10/2000 | Johansson |
| 6,142,388 | A | 11/2000 | Schwab |
| 6,152,388 | A | 11/2000 | Rohloff |
| 6,161,778 | A | 12/2000 | Haruch |
| 6,186,273 | B1 | 2/2001 | Goldbach et al. |
| 6,189,214 | B1 | 2/2001 | Skeath et al. |
| 6,289,676 | B1 | 9/2001 | Prociw et al. |
| 6,450,422 | B1 | 9/2002 | Maggio |
| 6,592,054 | B2 | 7/2003 | Prus |
| 6,659,367 | B2 | 12/2003 | Ballu |
| 6,669,112 | B2 | 12/2003 | Reetz et al. |
| 6,669,115 | B2 | 12/2003 | Sun et al. |
| 6,776,360 | B2 | 8/2004 | Haruch et al. |
| 6,808,122 | B2 | 10/2004 | Micheli |
| 7,028,916 | B2 | 4/2006 | Micheli |
| 7,311,271 | B2 | 12/2007 | Micheli |
| 7,762,476 | B2 | 7/2010 | Micheli |
| 2002/0195505 | A1 | 12/2002 | Haruch et al. |
| 2003/0066905 | A1 | 4/2003 | Huffman |
| 2003/0164406 | A1 | 9/2003 | Ballu |
| 2004/0031860 | A1 | 2/2004 | Micheli |
| 2004/0046040 | A1 | 3/2004 | Micheli |
| 2006/0000928 | A1 | 1/2006 | Micheli |
| 2006/0214027 | A1 | 9/2006 | Micheli |
| 2008/0048055 | A1 | 2/2008 | Micheli |

FOREIGN PATENT DOCUMENTS

| | | |
|---|---|---|
| EP | 1108476 | 6/2001 |
| EP | 1391246 | 2/2004 |
| EP | 1611958 | 1/2006 |
| JP | 463384 | 10/1971 |
| JP | 51000011 | 1/1976 |
| JP | 63319076 | 12/1988 |
| JP | 9094494 | 4/1999 |
| JP | 2001017893 | 1/2001 |
| TW | 200406259 | 5/2004 |
| TW | 200510069 | 3/2005 |
| WO | WO9407607 | 4/1994 |
| WO | WO0000770 | 1/2000 |
| WO | WO0102099 | 1/2001 |

FLUID ATOMIZING SYSTEM AND METHOD

CROSS-REFERENCE TO RELATED APPLICATIONS

This application is a continuation of U.S. patent application Ser. No. 11/445,076, entitled "Fluid Atomizing System and Method", filed on May 31, 2006, which is herein incorporated by reference in its entirety, which is a continuation-in-part of U.S. patent application Ser. No. 10/880,653, entitled "Fluid Atomizing System and Method", filed on Jun. 30, 2004, which is herein incorporated by reference in its entirety.

BACKGROUND

The present technique relates generally to spray systems and, more particularly, to industrial spray coating systems. The present technique specifically provides a system and method for improving atomization in a spray coating device by internally inducing fluid breakup.

Spray coating devices are used to apply a spray coating to a wide variety of produce types and materials, such as wood and metal. The spray coating fluids used for each different industrial application may have much different fluid characteristics and desired coating properties. For example, wood coating fluids/stains are generally viscous fluids, which may have significant particulate/ligaments throughout the fluid/stain. Existing spray coating devices, such as air atomizing spray guns, are often unable to breakup the foregoing particulate/ligaments. The resulting spray coating has an undesirably inconsistent appearance, which may be characterized by mottling and various other inconsistencies in textures, colors, and overall appearance. In air atomizing spray guns operating at relatively low air pressures, such as below 10 psi, the foregoing coating inconsistencies are particularly apparent.

SUMMARY

In accordance with certain embodiments, a system includes a spray device having a liquid pathway leading to a liquid exit, an air pathway leading to an air exit directed toward a spray region downstream of the liquid exit, and an assembly disposed in the liquid pathway adjacent the liquid exit. The assembly includes a threadless pintle generally fit into a sleeve in a concentric manner without threads. The assembly also includes a generally annular passage between the threadless pintle and the sleeve and a passage coupled with the generally annular passage. The generally annular passage also has a cross-sectional area that alternatingly increases and decreases in a lengthwise direction along the liquid pathway.

DRAWINGS

The foregoing and other advantages and features of the invention will become apparent upon reading the following detailed description and upon reference to the drawings in which.

DETAILED DESCRIPTION

As discussed in detail below, the present technique provides a refined spray for coating and other spray applications by internally inducing breakup of fluid passing through a spray coating device. This internal breakup is achieved by passing the fluid through one or more varying geometry passages, which may comprises sharp turns, abrupt expansions or contractions, or other mixture-inducing flow paths. For example, certain embodiments of the spray coating device may have a fluid delivery tip assembly, which has a sleeve disposed about a pintle to form a converging flow path. This converging flow path extends to a spray formation exit of the spray coating device. Thus, the converging flow path accelerates the fluid flow, thereby enhancing fluid atomization at the spray formation exit. For example, the increased fluid velocity may induce vortex shedding, fluid atomization, droplet distribution and uniformity, and so forth. Moreover, some embodiments of the fluid delivery tip assembly have helical channels to induce rotation of the fluid exiting at the spray formation exit of the spray coating device. Thus, the spray exhibits a vortical motion, which further enhances the spray. For example, the pintle and/or the sleeve may have a plurality of helical channels, which can have a variety of angles, sizes, and so forth. The present technique also may optimize the foregoing fluid breakup and atomization by varying the fluid velocities, degree of convergence and rotation, and other characteristics of the spray coating device.

Figure 1:
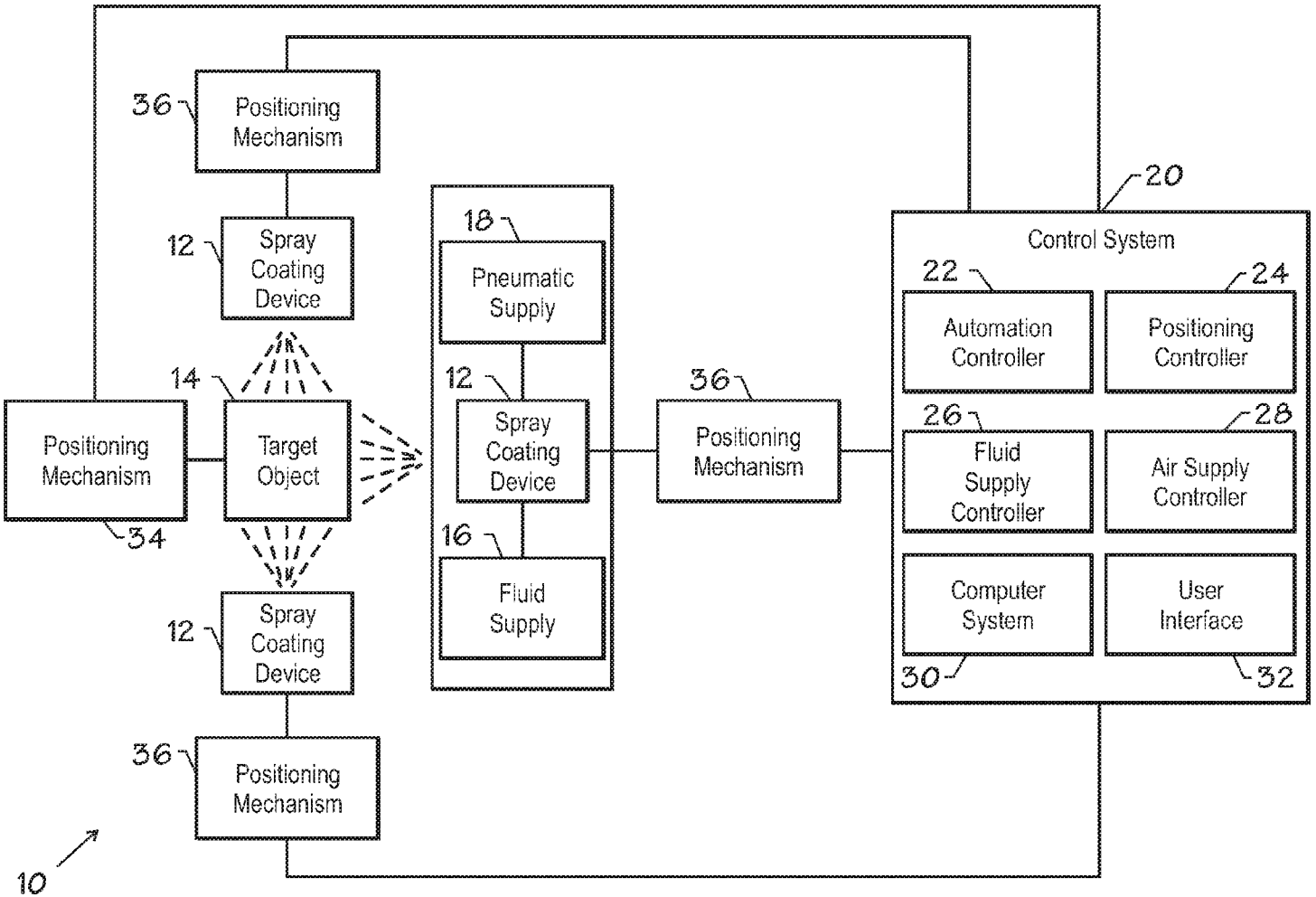
FIG. 1 is a diagram illustrating an exemplary spray coating system in accordance with certain embodiments of the present technique.

FIG. 1 is a flow chart illustrating an exemplary spray coating system 10, which comprises a spray coating device 12 for applying a desired coating to a target object 14. The illustrated spray coating device 12 may comprise an air atomizer, a rotary atomizer, an electrostatic atomizer, or any other suitable spray formation mechanism. As discussed in further detail below with reference to FIGS. 4-7, the spray coating device 12 also has a unique fluid delivery tip assembly 204 in accordance with certain embodiments of the present technique. The spray coating device 12 may be coupled to a variety of supply and control systems, such as a fluid supply 16, an air supply 18, and a control system 20. The control system 20 facilitates control of the fluid and air supplies 16 and 18 and ensures that the spray coating device 12 provides an acceptable quality spray coating on the target object 14. For example, the control system 20 may include an automation controller 22, a positioning controller 24, a fluid supply controller 26, an air supply controller 28, a computer system 30, and a user interface 32.

The control system 20 also may be coupled to one or more positioning mechanisms 34 and 36. For example, the positioning mechanism 34 facilitates movement of the target object 14 relative to the spray coating device 12. The positioning mechanism 36 is coupled to the spray coating device 12, such that the spray coating device 12 can be moved relative to the target object 14. Also, the system 10 can include a plurality of the spray coating devices 12 coupled to positioning mechanisms 36, thereby providing improved coverage of the target object 14. Accordingly, the spray coating system 10 can provide a computer-controlled mixture of coating fluid, fluid and air flow rates, and spray pattern/coverage over the target object. Depending on the particular application, the positioning mechanisms 34 and 36 may include a robotic arm, conveyor belts, and other suitable positioning mechanisms.

Figure 2:
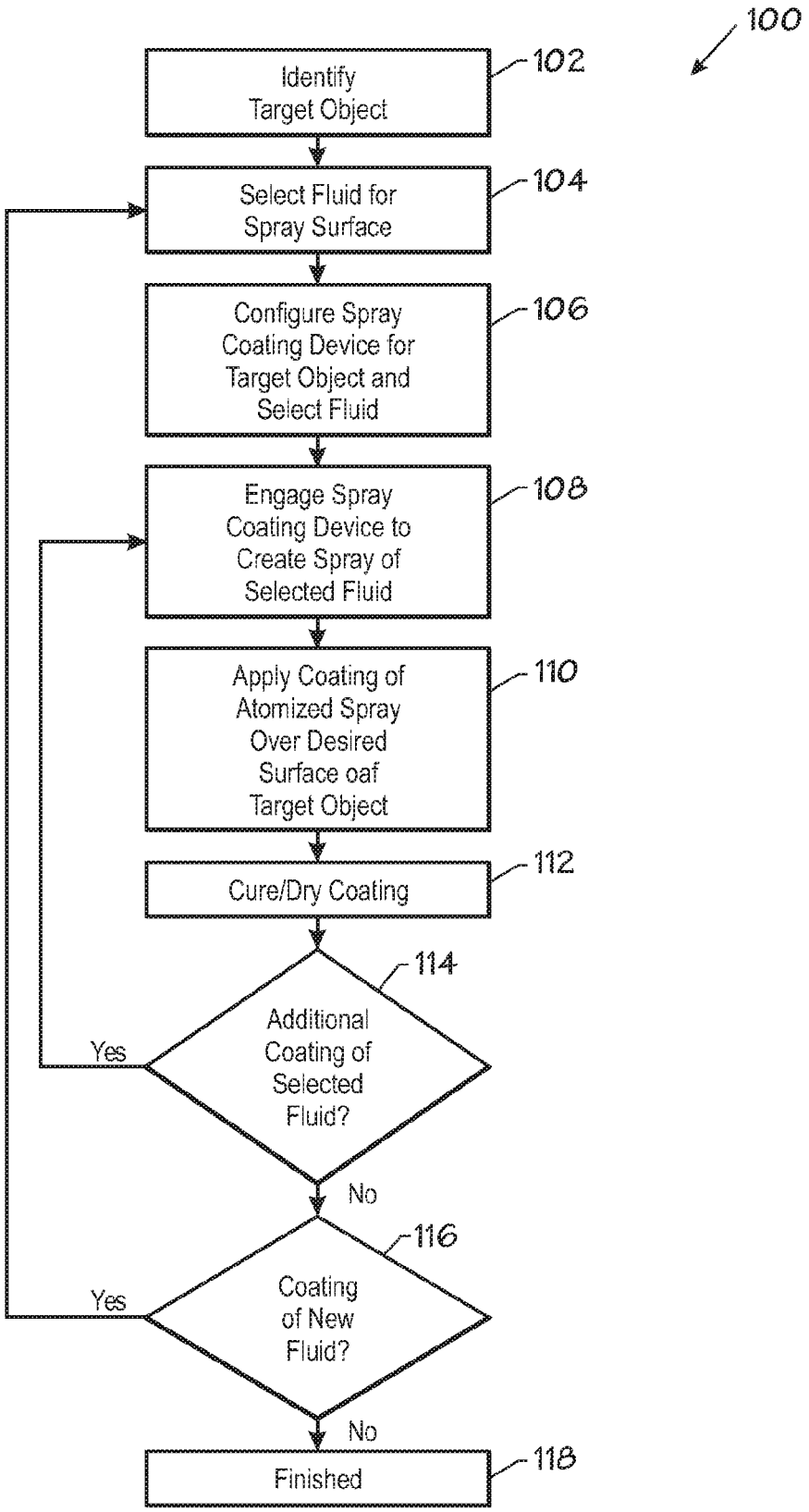
FIG. 2 is a flow chart illustrating an exemplary spray coating process in accordance with certain embodiments of the present technique.

FIG. 2 is a flow chart of an exemplary spray coating process 100 for applying a desired spray coating to the target object 14. As illustrated, the process 100 proceeds by identifying the target object 14 for application of the desired fluid (block 102). The process 100 then proceeds by selecting the desired fluid 40 for application to a spray surface of the target object 14 (block 104). A user may then proceed to configure the spray coating device 12 for the identified target object 14 and selected fluid 40 (block 106). As the user engages the spray coating device 12, the process 100 then proceeds to create an atomized spray of the selected fluid 40 (block 108). The user may then apply a coating of the atomized spray over the desired surface of the target object 14 (block 110). The process 100 then proceeds to cure/dry the coating applied over the desired surface (block 112). If an additional coating of the selected fluid 40 is desired by the user at query block 114, then the process 100 proceeds through blocks 108, 110, and 112 to provide another coating of the selected fluid 40. If the user does not desire an additional coating of the selected fluid at query block 114, then the process 100 proceeds to query block 116 to determine whether a coating of a new fluid is desired by the user. If the user desires a coating of a new fluid at query block 116, then the process 100 proceeds through blocks 104-114 using a new selected fluid for the spray coating. If the user does not desire a coating of a new fluid at query block 116, then the process 100 is finished at block 118.

Figure 3:
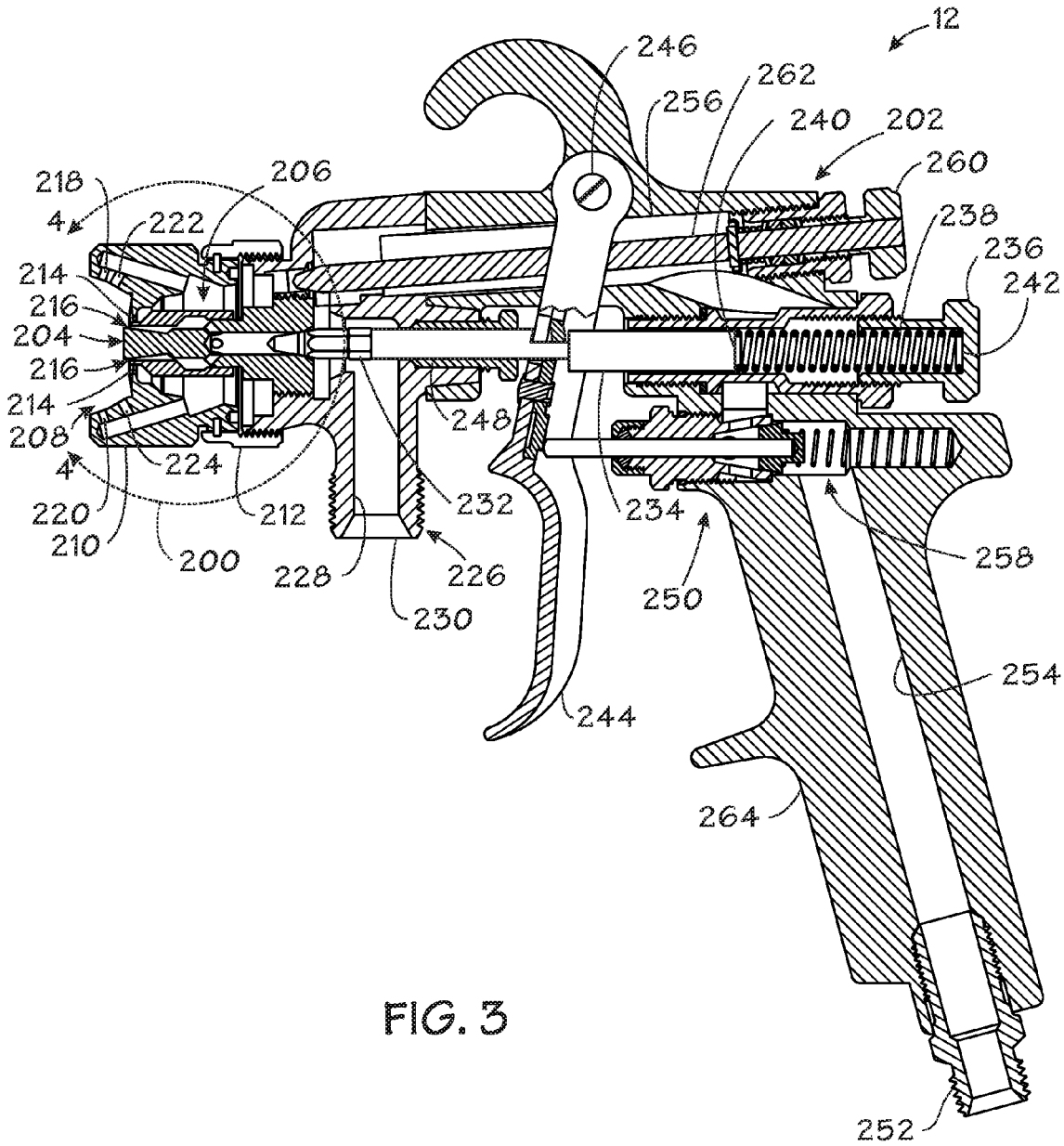
FIG. 3 is a cross-sectional side view of an exemplary spray coating device in accordance with certain embodiments of the present technique.

FIG. 3 is a cross-sectional side view illustrating an exemplary embodiment of the spray coating device 12. As illustrated, the spray coating device 12 comprises a spray tip assembly 200 coupled to a body 202. The spray tip assembly 200 includes a fluid delivery tip assembly 204, which may be removably inserted into a receptacle 206 of the body 202. For example, a plurality of different types of spray coating devices may be configured to receive and use the fluid delivery tip assembly 204. The spray tip assembly 200 also includes a spray formation assembly 208 coupled to the fluid delivery tip assembly 204. The spray formation assembly 208 may include a variety of spray formation mechanisms, such as air, rotary, and electrostatic atomization mechanisms. However, the illustrated spray formation assembly 208 comprises an air atomization cap 210, which is removably secured to the body 202 via a retaining nut 212. The air atomization cap 210 includes a variety of air atomization orifices, such as a central atomization orifice 214 disposed about a fluid tip exit 216 from the fluid delivery tip assembly 204. The air atomization cap 210 also may have one or more spray shaping orifices, such as spray shaping orifices 218, 220, 222, and 224, which force the spray to form a desired spray pattern (e.g., a flat spray). The spray formation assembly 208 also may comprise a variety of other atomization mechanisms to provide a desired spray pattern and droplet distribution.

The body 202 of the spray coating device 12 includes a variety of controls and supply mechanisms for the spray tip assembly 200. As illustrated, the body 202 includes a fluid delivery assembly 226 having a fluid passage 228 extending from a fluid inlet coupling 230 to the fluid delivery tip assembly 204. The fluid delivery assembly 226 also comprises a fluid valve assembly 232 to control fluid flow through the fluid passage 228 and to the fluid delivery tip assembly 204. The illustrated fluid valve assembly 232 has a needle valve 234 extending movably through the body 202 between the fluid delivery tip assembly 204 and a fluid valve adjuster 236. The fluid valve adjuster 236 is rotatably adjustable against a spring 238 disposed between a rear section 240 of the needle valve 234 and an internal portion 242 of the fluid valve adjuster 236. The needle valve 234 is also coupled to a trigger 244, such that the needle valve 234 may be moved inwardly away from the fluid delivery tip assembly 204 as the trigger 244 is rotated counter clockwise about a pivot joint 246. However, any suitable inwardly or outwardly openable valve assembly may be used within the scope of the present technique. The fluid valve assembly 232 also may include a variety of packing and seal assemblies, such as packing assembly 248, disposed between the needle valve 234 and the body 202.

An air supply assembly 250 is also disposed in the body 202 to facilitate atomization at the spray formation assembly 208. The illustrated air supply assembly 250 extends from an air inlet coupling 252 to the air atomization cap 210 via air passages 254 and 256. The air supply assembly 250 also includes a variety of seal assemblies, air valve assemblies, and air valve adjusters to maintain and regulate the air pressure and flow through the spray coating device 12. For example, the illustrated air supply assembly 250 includes an air valve assembly 258 coupled to the trigger 244, such that rotation of the trigger 244 about the pivot joint 246 opens the air valve assembly 258 to allow air flow from the air passage 254 to the air passage 256. The air supply assembly 250 also includes an air valve adjustor 260 coupled to a needle 262, such that the needle 262 is movable via rotation of the air valve adjustor 260 to regulate the air flow to the air atomization cap 210. As illustrated, the trigger 244 is coupled to both the fluid valve assembly 232 and the air valve assembly 258, such that fluid and air simultaneously flow to the spray tip assembly 200 as the trigger 244 is pulled toward a handle 264 of the body 202. Once engaged, the spray coating device 12 produces an atomized spray with a desired spray pattern and droplet distribution. Again, the illustrated spray coating device 12 is only an exemplary device of the present technique. Any suitable type or configuration of a spraying device may benefit from the unique fluid mixing, particulate breakup, and refined atomization aspects of the present technique.

Figure 4:
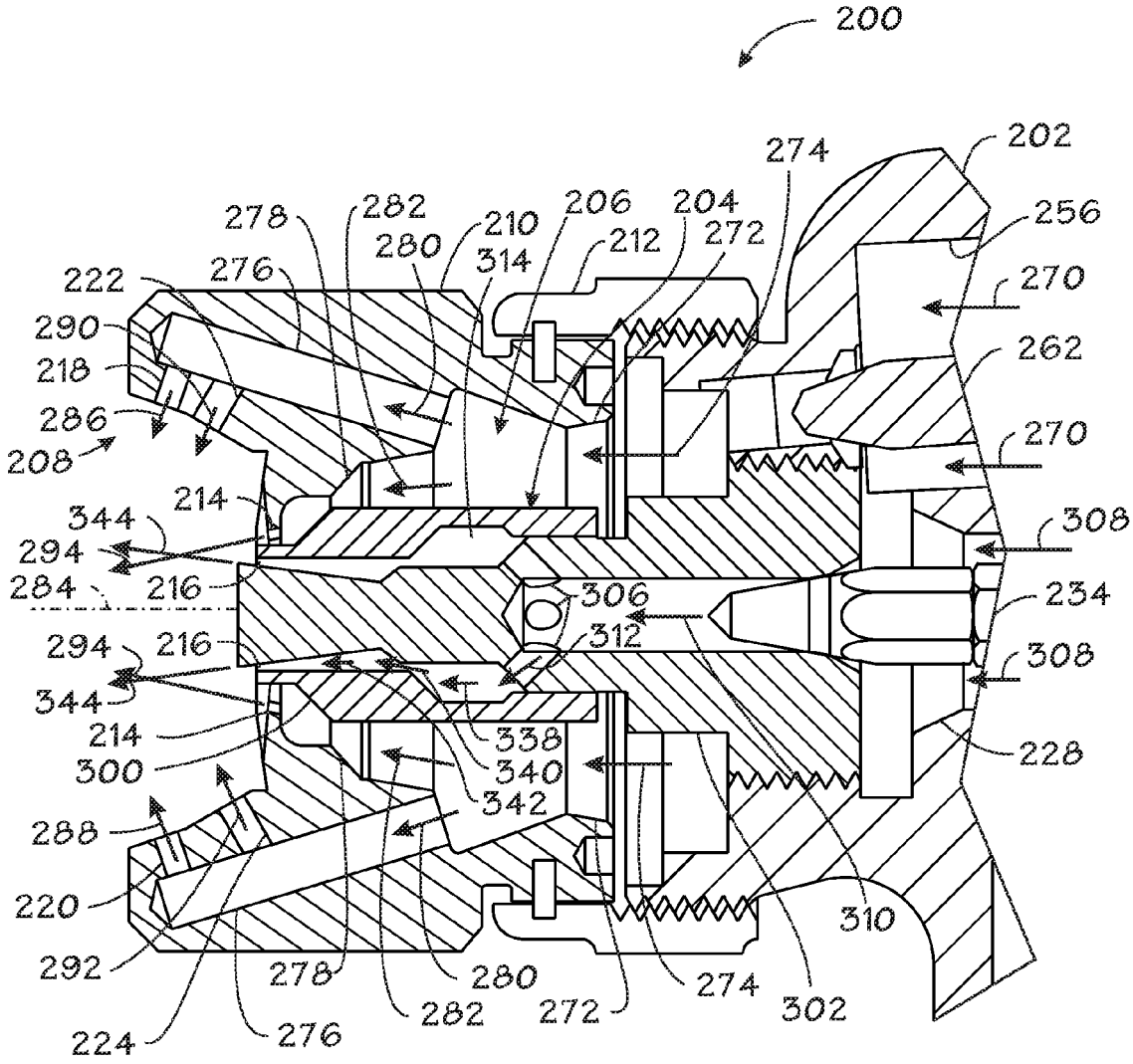
FIG. 4 is a partial cross-sectional view of an exemplary spray tip assembly of the spray coating device of FIG. 3 in accordance with certain embodiments of the present technique.

FIG. 4 is a partial cross-sectional view of the spray tip assembly 200 of the spray coating device 12 of FIG. 3 in accordance with certain embodiments of the present technique. As illustrated, the needle 262 of the air supply assembly 250 and the needle valve 234 of the fluid valve assembly 232 are both open, such that air and fluid passes through the spray tip assembly 200 as indicated by the arrows. Turning first to the air supply assembly 250, the air flows through air passage 256 about the needle 262 as indicated by arrow 270. The air then flows from the body 202 and into a central air passage 272 in the air atomization cap 210, as indicated by arrows 274. The central air passage 272 then splits into outer and inner air passages 276 and 278, such that the air flows as indicated by arrows 280 and 282, respectively. The outer passages 276 then connect with the spray shaping orifices 218, 220, 222, and 224, such that the air flows inwardly toward a longitudinal axis 284 of the spray tip assembly 200. These spray shaping airflows are illustrated by arrows 286, 288, 290, and 292. The inner passages 278 surround the fluid delivery tip assembly 204 and extend to the central atomization orifices 214, which are positioned adjacent the fluid tip exit 216 of the fluid delivery tip assembly 204. These central atomization orifices 214 eject air atomizing flows inwardly toward the longitudinal axis 284, as indicated by arrows 294. These air flows 286, 288, 290, 292, and 294 are all directed toward a fluid flow 344 ejected from the fluid tip exit 216 of the fluid delivery tip assembly 204. In operation, these air flows 286, 288, 290, 292, and 294 facilitate fluid atomization to form a spray and, also, shape the spray into a desired pattern (e.g., flat, rectangular, oval, etc.).

Figure 5:
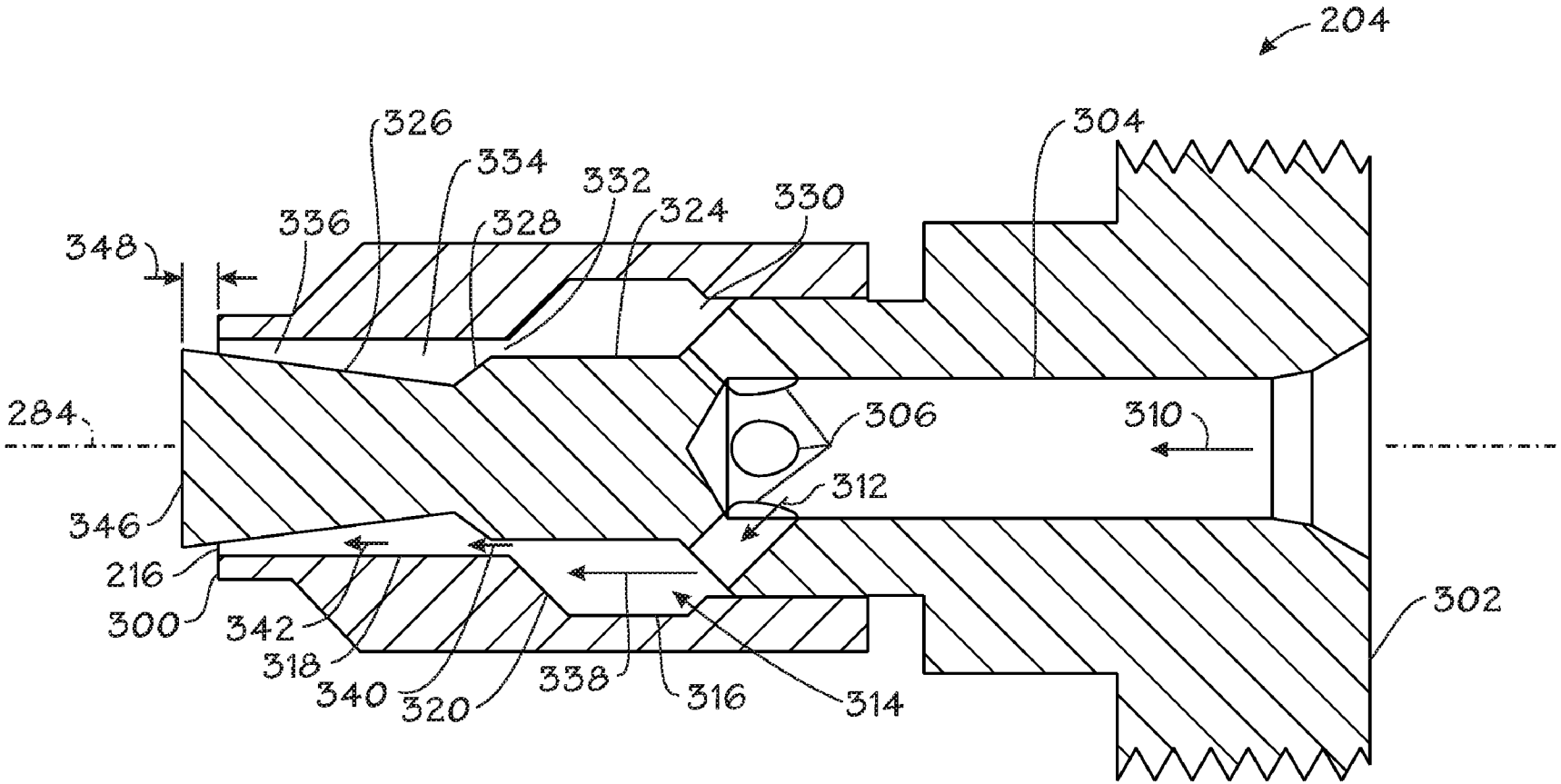
FIG. 5 is a cross-sectional view of an exemplary fluid delivery tip assembly of the spray tip assembly of FIG. 4 in accordance with certain embodiments of the present technique.

Turning to the fluid flow in the spray tip assembly 200, the fluid delivery tip assembly 204 includes an annular casing or sleeve 300 disposed about central member or pintle 302, as illustrated by FIGS. 4 and 5. The illustrated pintle 302 includes a central fluid passage or preliminary chamber 304, which leads to one or more restricted passageways or supply holes 306. These supply holes 306 can have a variety of geometries, angles, numbers, and configurations (e.g., symmetrical or non-symmetrical) to adjust the velocity, direction, and flow rate of the fluid flowing through the fluid delivery tip assembly 204. For example, in certain embodiments, the pintle 302 may include six supply holes 306 disposed symmetrically about the longitudinal axis 284 of the spray tip assembly 200. In operation, when the needle valve 234 is open, a desired fluid (e.g., paint) flows through fluid passage 228 about the needle valve 234 of the fluid valve assembly 232, as indicated by arrows 308. The fluid then flows into the central fluid passage or preliminary chamber 304 of the pintle 302, as indicated by arrow 310. As indicated by arrow 312, the supply holes 306 then direct the fluid flow from the preliminary chamber 304 into a secondary chamber or throat 314.

The illustrated throat 314 of FIGS. 4 and 5 is disposed between the sleeve 300 and the pintle 302. In the illustrated embodiment, the geometry of the throat 314 substantially diverges and converges toward the fluid tip exit 216 of the fluid delivery tip assembly 204. In operation, these diverging and converging flow pathways induce fluid mixing and breakup prior to primary air atomization by the air orifices 214, 218, 220, 222, and 224 of the air atomization cap 210. For example, successive diverging and converging flow passages can induce velocity changes in the fluid flow, thereby inducing fluid mixing, turbulence, and breakup of particulate in the fluid.

In the illustrated embodiment of FIGS. 4 and 5, the diverging and converging geometries of the throat 314 are defined by the pintle 302 and by the sleeve 300. The illustrated sleeve 300 defines the outer boundaries of the throat 314. For example, the illustrated sleeve 300 includes a first annular interior 316, a second annular interior 318, and a converging interior 320 that is angled inwardly from the first annular interior 316 to the second annular interior 318. Thus, the first annular interior 316 has a relatively larger diameter than the second annular interior 318. In alternative embodiments, one or more of the sleeve interiors 316, 318, and 320 may have a non-circular geometry (e.g., square, polygonal, etc.). Furthermore, some embodiments of the sleeve interiors 316, 318, and 320 may have a non-annular geometry, such as a plurality of separate passages rather than a single annular geometry.

The illustrated pintle 302 defines the inner boundaries of the throat 314. As illustrated, a forward portion or tip section 322 of the pintle 302 includes an annular section 324, a diverging annular section or conic tip portion 326, and a converging annular section 328 extending from the annular section 324 280 to the conic tip portion 326. In other words, with reference to the longitudinal axis 284, the annular section 324 has a substantially constant diameter, the conic tip portion 326 is angled outwardly from the longitudinal axis 284 toward the fluid tip exit 216, and the converging annular section 328 is angled inwardly from the annular section 324 to the tonic tip portion 326. Again, other embodiments of the tip section 322 of the pintle 302 can have a variety of constant, inwardly angled, or outwardly angled sections, which define the inner boundaries of the throat 314.

As assembled in FIGS. 4 and 5, the sleeve 300 and pintle 302 have the sleeve interiors 316, the 320, and 318 surrounding the pintle sections 324, 328, and 326, thereby defining an annular passage 330, substantially restricted/unrestricted passages 332 and 334, and a progressively converging annular passage 336, respectively. In other words, the annular passage 330 has a relatively constant flow area, which in certain embodiments may be relatively larger than a flow area of the preliminary chamber 304. In turn, the restricted passage 332 abruptly converges or decreases the flow area where the leading end of the pintle section 328 meets the trailing end of the sleeve interior 320. Next, the pintle section 328 expands or increases the flow area relative to the sleeve interior 318. Finally the pintle section 326 contracts or decreases the flow area relative to the sleeve interior 318. As a benefit of these increasing and decreasing flow areas, the fluid delivery tip assembly 204 causes decreases and increases in the fluid flow velocity and, also, abrupt and gradual changes in fluid flow directions. Therefore, the fluid delivery tip assembly 214 enhances fluid mixing and fluid breakup (e.g., more viscous fluids or particulate), and may induce turbulent flow.

Regarding the fluid flow through the throat 314, the illustrated arrows 338, 340, and 342 indicate fluid flow pathways through the annular passage 330, through the substantially restricted/unrestricted passages 332 and 334, and through the progressively converging annular passage 336, respectively. At the fluid tip exit 216, the fluid flows out to form a sheet or cone of fluid as indicated by arrow 344. Simultaneously, the air flows 286, 288, 290, 292, and 294 from the air cap 210 coincide with the fluid sheet or cone 344, thereby atomizing the fluid and shaping a desired formation of the spray. In addition, as illustrated in FIG. 5, a tip 346 of the pintle 302 extends beyond the fluid tip exit 216 by a distance 348, which advantageously induces vortex shedding to further enhance the fluid breakup and atomization. Moreover, at the fluid tip exit 216, the increased fluid velocity attributed to the progressively converging annular passage 336 of the throat 314 further increases the velocity differential between the exiting fluid 344 and the environmental air. This increased velocity further enhances the vortex shedding and, also, substantially reduces back flow into the fluid delivery tip assembly 204.

Figure 6:
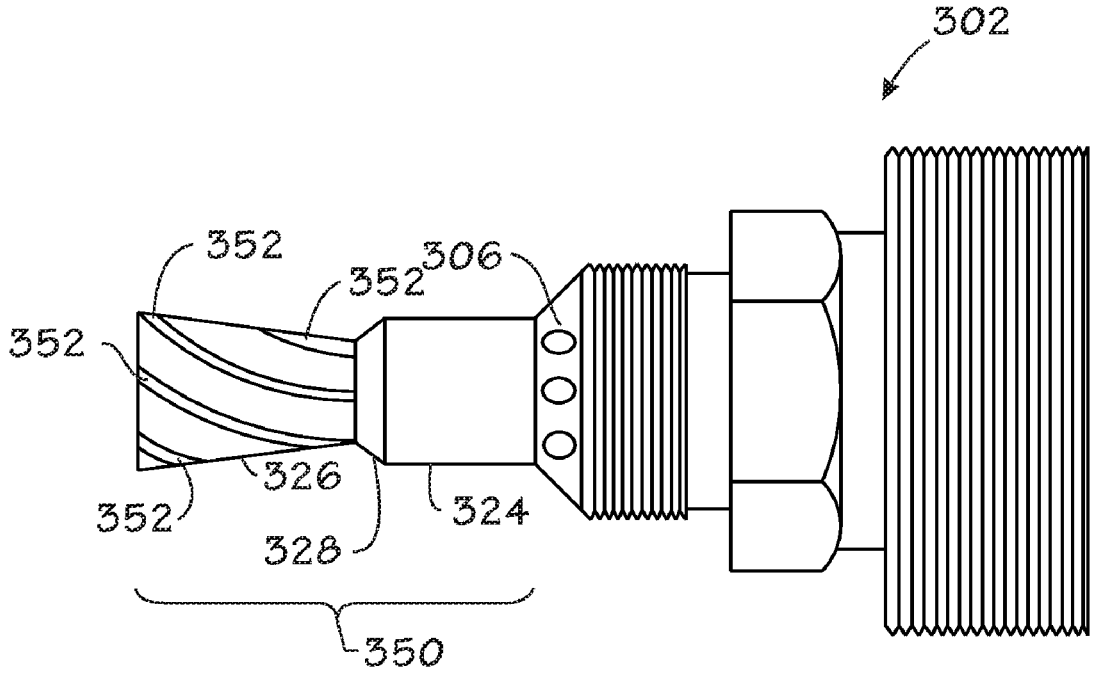
FIG. 6 is a cross-sectional view of an alternative pintle of the fluid delivery tip assembly of FIG. 5 having a plurality of helical fluid channels in accordance with certain embodiments of the present technique.
Figure 7:
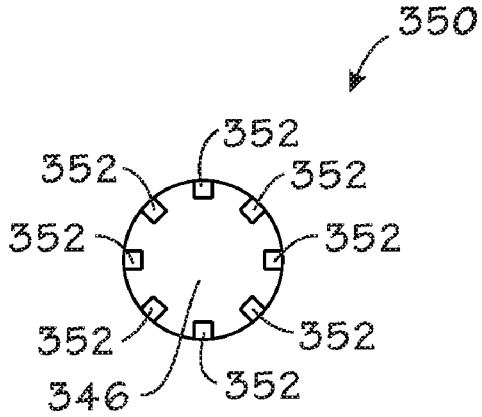
FIG. 7 is a front view of the alternative pintle of FIG. 6 in accordance with certain embodiments of the present technique.

FIGS. 6 and 7 illustrate the pintle 302 having an alternative tip section 350 in accordance with certain embodiments of the present technique. Turning first to FIG. 6, a cross-sectional view of the pintle 302 illustrates the alternative tip section 350 having a plurality of helical fluid channels 352 in accordance with certain embodiments of the present technique. As illustrated, the helical fluid channels 352 are disposed about the conic tip section 326. In operation, these helical fluid channels 352 induce rotational motion or vortical fluid flow of the converging/accelerating fluid flow passing through the converging annular passage 336. When the fluid delivery tip assembly 204 ejects this fluid at the fluid tip exit 216 (see FIGS. 4 and 5), these helical fluid channels 352 cause the spray to exhibit rotation or vortical motion, thereby enhancing fluid atomization, mixing, and droplet distribution and uniformity. These helical fluid channels 352 may have any suitable angle, geometry, configuration, and orientation within the scope of the present technique. For example, some embodiments of the helical fluid channels 352 may include four, six, eight, or ten symmetrical channels, which may have an angle of 15, 30, 45, or 60 degrees. FIG. 7 is a front view of one embodiment of the pintle section 350 of FIG. 6 having eight of the helical fluid channels 352, wherein the channels 352 have a rectangular cross-section. In addition, certain embodiments of the helical fluid channels may extend along the other sections 324 and 328 of the pintle tip section 350. Moreover, alternative embodiments can have helical channels disposed on one or more of the sleeve interiors 316, 318, and 320.

Figure 8:
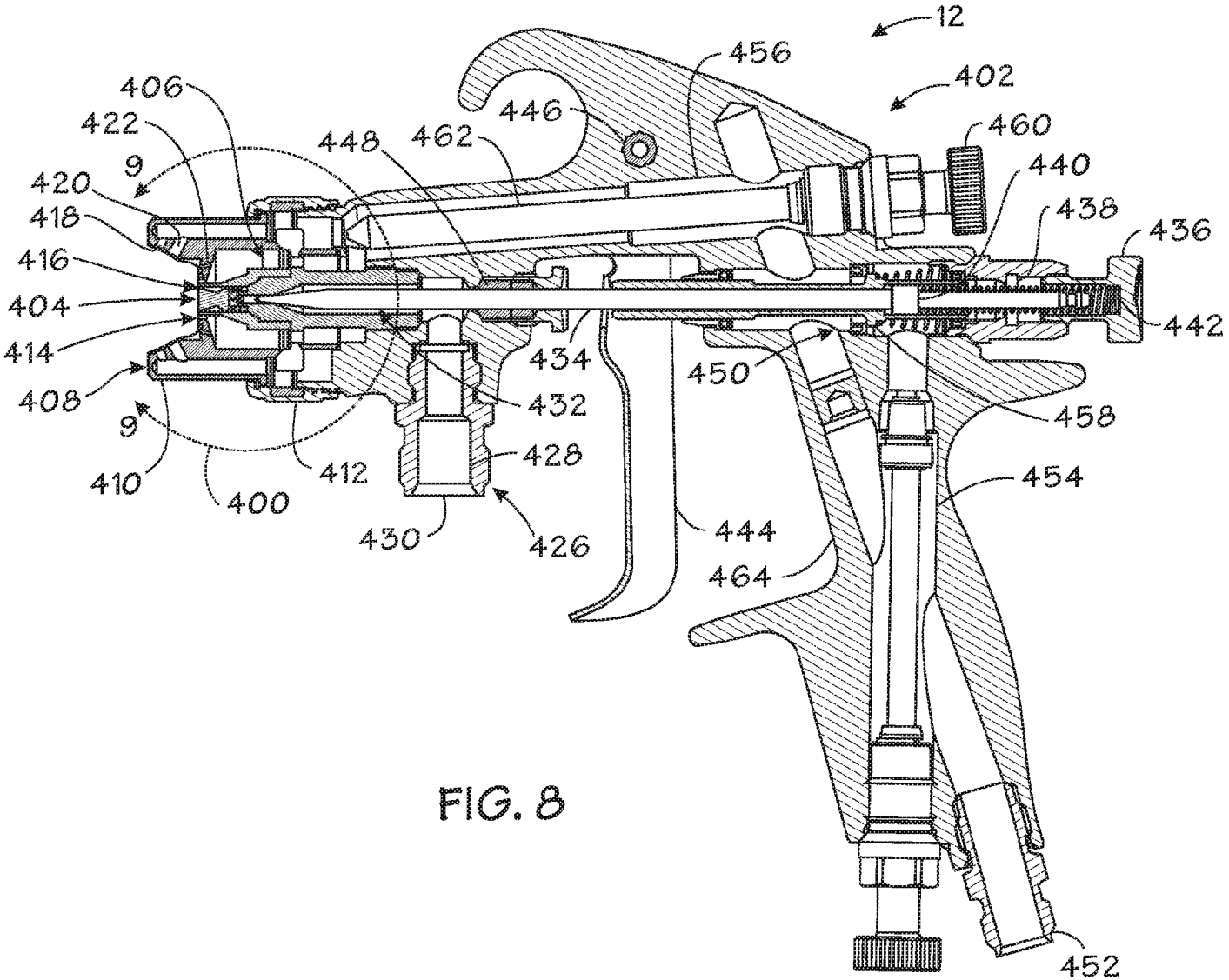
FIG. 8 is a cross-sectional side view of a spray coating device having an alternative spray tip assembly in accordance with certain embodiments of the present technique.

FIG. 8 is a cross-sectional side view illustrating an exemplary embodiment of the spray coating device 12. As illustrated, the spray coating device 12 comprises a spray tip assembly 400 coupled to a body 402. The spray tip assembly 400 includes a fluid delivery tip assembly 404, which may be removably inserted into a receptacle 406 of the body 402. For example, a plurality of different types of spray coating devices may be configured to receive and use the fluid delivery tip assembly 404. As discussed in detail below, the illustrated fluid delivery tip assembly 404 substantially improves the concentricity between the parts (e.g., sleeve 500 and pintle 502), thereby providing a substantially symmetric annular flow that improves the uniformity of spray forming downstream from the spray coating device 12. For example, as discussed below with reference to FIGS. 9-14, the sleeve 500 and pintle 502 may be press fit together without threads, thereby reducing or generally eliminating the possibility of an asymmetric or non-concentric relationship between the sleeve 500 and pintle 502. In other words, the pintle 502 may be described as threadless or without any threads for mounting to the sleeve 502 or other components. Thus, the pintle 502 may be secured solely by the press fit engagement within the sleeve 500. In the illustrated embodiment, the pintle 502 also may be contained completely within the boundaries of the sleeve 500. In other words, the pintle 502 may not extend lengthwise outside the sleeve 500. In addition, as discussed below, the pintle 502 may include angled passages or supply holes 506 to facilitate internal fluid mixing, breakup, and swirl. Finally, the illustrated spray tip assembly 400 may use less air to atomize the generally annular or conical fluid flow exiting from the fluid delivery tip assembly 404.

The spray tip assembly 400 also includes a spray formation assembly 408 coupled to the fluid delivery tip assembly 404. The spray formation assembly 408 may include a variety of spray formation mechanisms, such as air, rotary, and electrostatic atomization mechanisms. However, the illustrated spray formation assembly 408 comprises an air atomization cap 410, which is removably secured to the body 402 via a retaining nut 412. The air atomization cap 410 includes a variety of air atomization orifices, such as a central atomization orifice 414 disposed about a fluid tip exit 416 from the fluid delivery tip assembly 404. The air atomization cap 410 also may have one or more spray shaping orifices, such as spray shaping orifices 418, 420, and 422, which force the spray to form a desired spray pattern (e.g., a flat spray). The spray formation assembly 408 also may comprise a variety of other atomization mechanisms to provide a desired spray pattern and droplet distribution.

The body 402 of the spray coating device 12 includes a variety of controls and supply mechanisms for the spray tip assembly 400. As illustrated, the body 402 includes a fluid delivery assembly 426 having a fluid passage 428 extending from a fluid inlet coupling 430 to the fluid delivery tip assembly 404. The fluid delivery assembly 426 also comprises a fluid valve assembly 432 to control fluid flow through the fluid passage 428 and to the fluid delivery tip assembly 404. The illustrated fluid valve assembly 432 has a needle valve 434 extending movably through the body 402 between the fluid delivery tip assembly 404 and a fluid valve adjuster 436. The fluid valve adjuster 436 is rotatably adjustable against a spring 438 disposed between a rear section 440 of the needle valve 434 and an internal portion 442 of the fluid valve adjuster 436. The needle valve 434 is also coupled to a trigger 444, such that the needle valve 434 may be moved inwardly away from the fluid delivery tip assembly 404 as the trigger 444 is rotated counter clockwise about a pivot joint 446. However, any suitable inwardly or outwardly openable valve assembly may be used within the scope of the present technique. The fluid valve assembly 432 also may include a variety of packing and seal assemblies, such as packing assembly 448, disposed between the needle valve 434 and the body 402.

An air supply assembly 450 is also disposed in the body 402 to facilitate atomization at the spray formation assembly 408. The illustrated air supply assembly 450 extends from an air inlet coupling 452 to the air atomization cap 410 via air passages 454 and 456. The air supply assembly 450 also includes a variety of seal assemblies, air valve assemblies, and air valve adjusters to maintain and regulate the air pressure and flow through the spray coating device 12. For example, the illustrated air supply assembly 450 includes an air valve assembly 458 coupled to the trigger 444, such that rotation of the trigger 444 about the pivot joint 446 opens the air valve assembly 458 to allow air flow from the air passage 454 to the air passage 456. In the illustrated embodiment, the air valve assembly 458 is disposed concentrically about a portion of the fluid valve assembly 432. The air supply assembly 450 also includes an air valve adjustor 460 coupled to a needle 462, such that the needle 462 is movable via rotation of the air valve adjustor 460 to regulate the air flow to the air atomization cap 410. As illustrated, the trigger 444 is coupled to both the fluid valve assembly 432 and the air valve assembly 458, such that fluid and air simultaneously flow to the spray tip assembly 400 as the trigger 444 is pulled toward a handle 464 of the body 402. Once engaged, the spray coating device 12 produces an atomized spray with a desired spray pattern and droplet distribution. Again, the illustrated spray coating device 12 is only an exemplary device of the present technique. Any suitable type or configuration of a spraying device may benefit from the unique fluid mixing, particulate breakup, and refined atomization aspects of the present technique.

Figure 9:
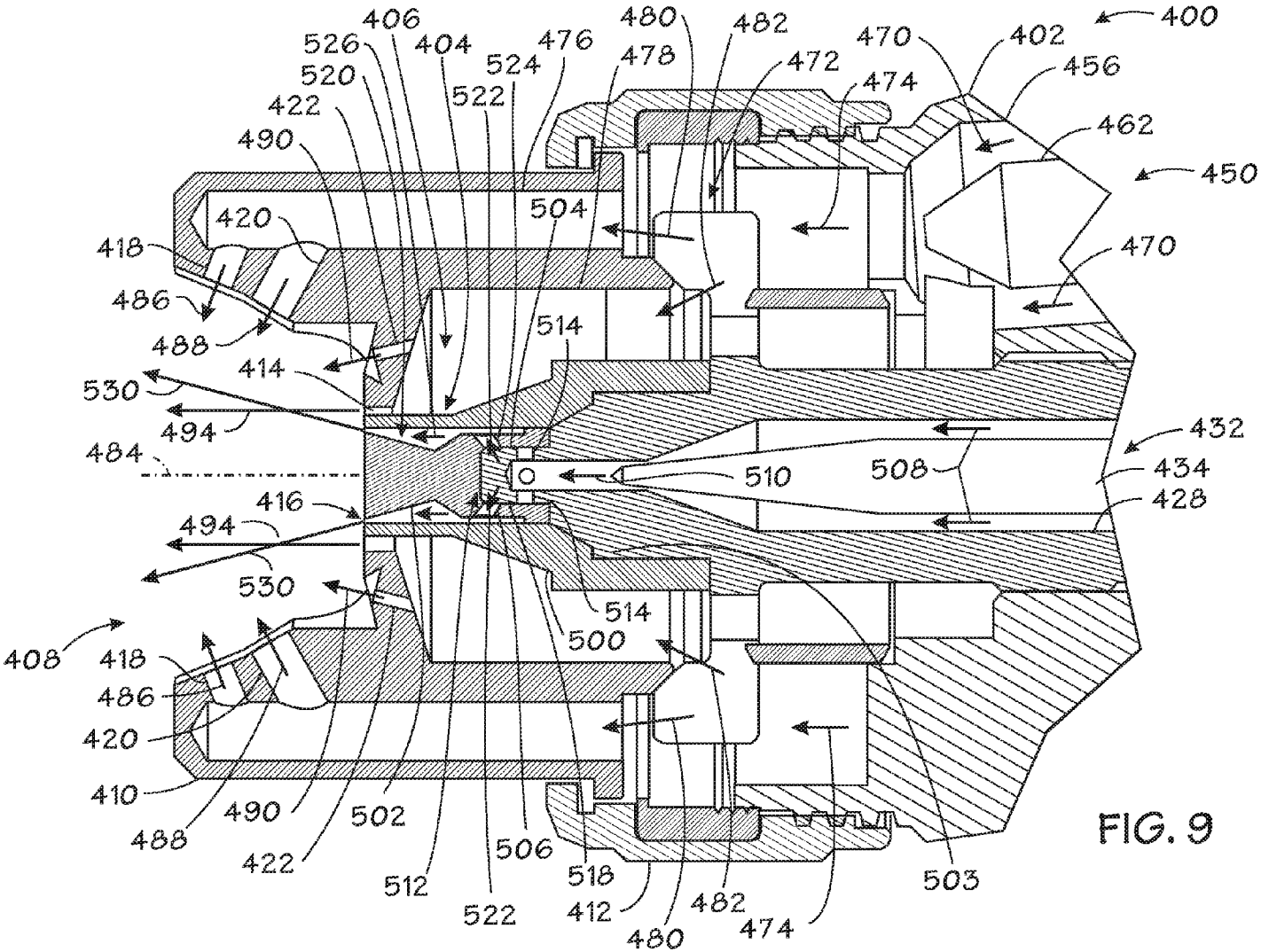
FIG. 9 is a partial cross-sectional side view of the spray coating device of FIG. 8, further illustrating the alternative spray tip assembly with a fluid tip delivery assembly in accordance with certain embodiments of the present technique.

FIG. 9 is a partial cross-sectional view of the spray tip assembly 400 of the spray coating device 12 of FIG. 8 in accordance with certain embodiments of the present technique. As illustrated, the needle 462 of the air supply assembly 450 and the needle valve 434 of the fluid valve assembly 432 are both open, such that air and fluid passes through the spray tip assembly 400 as indicated by the arrows. Turning first to the air supply assembly 450, the air flows through air passage 456 about the needle 462 as indicated by arrow 470. The air then flows from the body 402 and into a central air passage 472 in the air atomization cap 410, as indicated by arrows 474. The central air passage 472 then splits into outer and inner air passages 476 and 478, such that the air flows as indicated by arrows 480 and 482, respectively. The outer passages 476 then connect with the spray shaping orifices 418, 420, and 422, such that the air flows inwardly toward a longitudinal axis 484 of the spray tip assembly 400. These spray shaping airflows are illustrated by arrows 486, 488, and 490. The inner passages 478 surround the fluid delivery tip assembly 404 and extend to the central atomization orifices 414, which are positioned adjacent the fluid tip exit 416 of the fluid delivery tip assembly 404. These central atomization orifices 414 eject air atomizing flows in a generally parallel direction relative to the longitudinal axis 484, as indicated by arrows 494. However, the air atomizing flows from the orifices 414 may extend in a generally outward angled direction relative to the longitudinal axis 48 in some embodiments. These air flows 486, 488, 490, and 494 are all directed toward a fluid flow ejected from the fluid tip exit 416 of the fluid delivery tip assembly 404. In operation, these air flows 486, 488, 490, and 494 facilitate fluid atomization to form a spray and, also, shape the spray into a desired pattern (e.g., flat, rectangular, oval, etc.).

Turning to the fluid flow in the spray tip assembly 400, the fluid delivery tip assembly 404 includes an annular casing or sleeve 500 disposed about central member or pintle 502. As discussed in detail below, the sleeve 500 and pintle 502 may be coupled together without any threads, for example, by press fitting or piloting the pintle 502 into the sleeve 500 in a generally concentric configuration. Again, the pintle 502 may be described as a threadless pintle or a pintle without threads. The pintle 502 also may be at least substantially or entirely contained within the boundaries of the sleeve 500. In addition, the illustrated annular casing or sleeve 500 and the central member or pintle 402 are both disposed partially about or concentrically around a portion of an inner annular member or nozzle 503. For example, the sleeve 500 may be threaded onto the nozzle 503 or, alternatively, press fit, latched, or generally removably coupled to the nozzle 503. Thus, the sleeve 500 and the pintle 502 are removable from the nozzle 503 for maintenance, replacement, servicing, and so forth. Given the relatively small size of the sleeve 500 and the pintle 502, this removability is particularly useful because the nozzle 503 and many other larger parts can remain in the device 12 while the sleeve 500 and pintle 502 are serviced or replaced. The illustrated pintle 502 includes a central passage or receptacle 504, which leads to one or more restricted passageways or supply holes 506 (e.g., four holes). These supply holes 506 can have a variety of geometries, angles, numbers, and configurations (e.g., symmetrical or non-symmetrical) to adjust the velocity, direction, and flow rate of the fluid flowing through the fluid delivery tip assembly 404. For example, in certain embodiments, the pintle 502 may include two, three, four, five, six, or more supply holes 506 disposed symmetrically about the longitudinal axis 484 of the spray tip assembly 400.

In operation, when the needle valve 434 is open, a desired fluid (e.g., paint) flows through fluid passage 428 about the needle valve 434 of the fluid valve assembly 432, as indicated by arrows 508. Thus, the fluid flows through the nozzle 503 leading to the pintle 502 and the sleeve 500. The fluid then flows into the central passage or receptacle 504 of the pintle 502, as indicated by arrow 510. At this region, the fluid flow splits into the supply holes 506. In the illustrated embodiment, a tip portion 512 of the nozzle 503 extends into the receptacle 504 of the pintle 502. In the tip portion 512, the nozzle 503 includes fluid passages 514 (e.g., four passages), which generally lead or direct the fluid flow to the supply holes 506 (e.g., four holes) disposed in the pintle 502. More specifically, the supply holes 506 and the fluid passages 514 may be fluidly coupled together via an interspace or annular gap 518 between the pintle 502 and the tip portion 512 of the nozzle 503. Therefore, the fluid flows through the fluid passages 514, through the annular gap 518, through the supply holes 506, and into a throat or generally annular chamber 520, as indicated by arrows 522. The fluid then flows through the generally annular chamber 520 from the supply holes 506 to the fluid tip exit 416, as indicated by arrows 524. Finally, the fluid discharges from the generally annular chamber 520 of the fluid tip delivery assembly 404, as indicated by arrow 530.

As discussed in further detail below, the illustrated throat or generally annular chamber 520 of FIG. 9 has a varying geometry between the sleeve 500 and the pintle 502. In the illustrated embodiment, the geometry of the throat 520 substantially diverges and converges toward the fluid tip exit 416 of the fluid delivery tip assembly 404. In operation, these diverging and converging flow pathways induce fluid mixing and breakup prior to primary air atomization by the air orifices 414, 418, 420, and 422 of the air atomization cap 410. For example, successive diverging and converging flow passages can induce velocity changes in the fluid flow, thereby inducing fluid mixing, turbulence, and breakup of particulate in the fluid.

Figure 10:
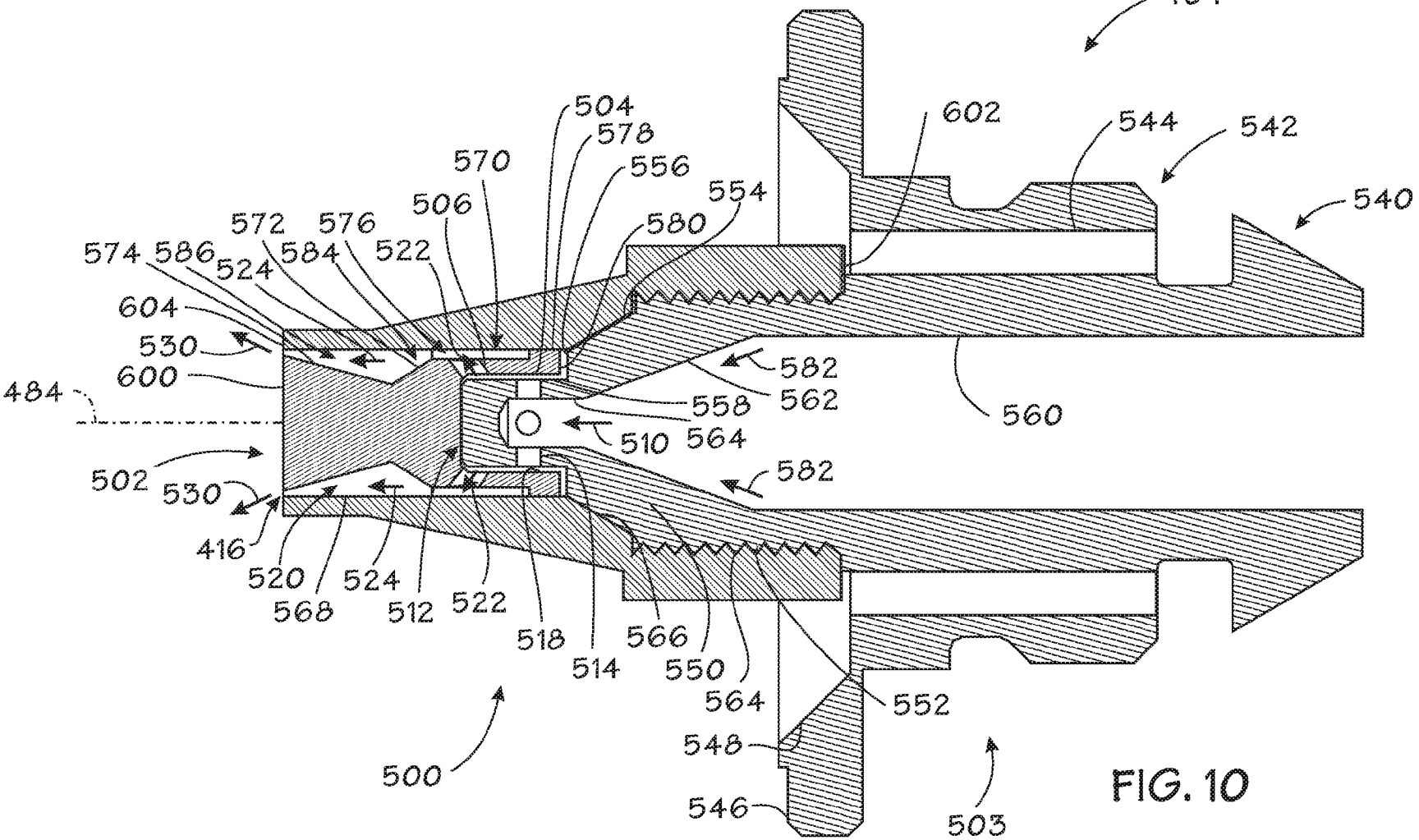
FIG. 10 is a partial cross-sectional side view of an alternative fluid tip delivery assembly of the spray tip assembly of FIG. 9 in accordance with certain embodiments of the present technique.

FIG. 10 is a cross-sectional view of one embodiment of the fluid delivery tip assembly 404 as illustrated in FIGS. 8 and 9, further illustrating geometries, interfaces, and general flow patterns between the annular casing or sleeve 500, the central member or pintle 502, and the nozzle 503. As illustrated, the nozzle 503 includes a rear coupling portion 540, an intermediate portion 542, air passages 544 disposed in the intermediate portion 542, a protruding annular member or flange portion 546, a recess 548 disposed in the flange portion 546, a front protruding portion or converging nozzle head 550, and the tip portion 512. The converging nozzle head 550 also includes a threaded exterior 552, a tapered exterior or conical surface interface 554, an annular end 556, and a generally cylindrical surface 558 of the tip portion 512. In addition, the interior of the nozzle 502 includes a first interior or generally cylindrical passage 560, a second interior or generally tapered or conical valve interface 562, and a third interior or generally cylindrical fluid distribution chamber 564. As discussed above, the nozzle 503 also includes the lateral or radial passages 514 extending outwardly from the fluid distribution chamber 464 within the tip portion 512. In the illustrated embodiment, the sleeve 500 and the pintle 502 are engaged with one another and portions of the nozzle 503. Specifically, the sleeve 500 is threadingly and wedgingly coupled to the converging nozzle head 550 of the nozzle 503. The pintle 502 is disposed about the tip portion 512 of the nozzle 503 and is generally fit in a concentric, symmetrical, or centered manner within the sleeve 500.

As illustrated in FIG. 10, the sleeve 500 includes a first interior or threaded nozzle interface 564, a second interior or generally tapered inner surface 566, and a third interior or generally cylindrical passage 568. In the illustrated embodiment, the sleeve 500 may be coupled to the nozzle 503 by threading the threaded nozzle interface 564 about the threaded exterior 552 of the converging nozzle head 550. Eventually, the threaded engagement between the sleeve 500 and the nozzle 503 forces the tapered inner surface 566 of the sleeve 500 to wedgingly engage the conical surface interface 554 of the converging nozzle head 550. In certain embodiments, the pintle 502 may be inserted before or after assembling the sleeve 500 with the nozzle 503.

The illustrated pintle 502 includes a first exterior or generally cylindrical outer surface 570, a second exterior or converging outer surface 572, and a third exterior or diverging outer surface 574. In addition, the illustrated cylindrical outer surface 570 may include one or more recesses or slots 576 disposed across the supply holes 506 and leading to the converging outer surface 572. In the illustrated embodiment, the slots 576 also leave a generally complete annual flange portion 578 at a first end or inner side 580 of the pintle 502. In addition, the pintle 502 may be press fit into the cylindrical passage 568 of the sleeve 500 without any threads. In this manner, the pintle 502 is generally centered within the sleeve 500, thereby creating substantially or completely symmetrical flow passages between the pintle 502 and the annular casing or sleeve 500. In other words, the sleeve 500 and the pintle 502 are generally coupled together without any eccentricities caused by the rotational engagement between male and female threads. Again, the pintle 502 may be press fit lengthwise into the annular casing or sleeve 500 before or after coupling the sleeve 500 to the nozzle 503. As appreciated, the threaded coupling between the nozzle 503 and the sleeve 500 carrying the pintle 502 enables easy access, removal, servicing, maintenance, and encasement of the sleeve 500 and the pintle 502 separate from the nozzle 503 and other large or complex components.

In the illustrated embodiment of FIG. 10, the inner and outer geometries of the sleeve 500, the pintle 502, and the nozzle 503 define a plurality of constricted passages, converging passages, and diverging passages configured to increase fluid mixing, breakup, and general turbulence before fluid ejection as indicated by arrows 530. In this manner, the fluid becomes more uniform, for example, by breaking up particulate, lumps, or other undesirable characteristics of the fluid (e.g., paint or coating material). For example, the nozzle 503 generally constricts or converges the fluid flow through the conical valve interface 562 leading from the cylindrical passage 560 to the fluid distribution chamber 564 as indicated by arrows 582.

The nozzle 503 then further constricts the fluid flow from the fluid distribution chamber 564 into the passages 514. Again, the passages 514 are oriented in a generally radially outward direction relative to the axis 484. In certain embodiments, the passages 514 may be angled in a generally downstream direction or, alternatively, a generally upstream direction relative to the axis 484. Furthermore, some embodiments of the passages 514 may be radially angled or oriented in a radial direction that is offset from the axis 484 to create a swirling flow. In other words, each of the passages 514 may have an axis that is angled and offset relative to the lengthwise direction or axis 484 along the liquid pathway, such that the axis of each passage 514 does not intersect with the lengthwise direction or axis 484. In general, the illustrated passages 514 restrict the flow in a generally crosswise direction to facilitate fluid mixing, breakup, and general turbulence of the fluid prior to exiting the fluid delivery tip assembly 404.

In the illustrated embodiment, the generally cylindrical surface 558 of the tip portion 512 of the nozzle 503 has a generally smaller radius or diameter than the receptacle 504 of the pintle 502, thereby creating the annular gap 518 as discussed in detail above. As a result, the fluid enters the fluid distribution chamber 564 as indicated by arrow 510, radially outward through the passages 514 in the tip portion 512, and then annularly through the annular gap 518 between the tip portion 512 and the receptacle 504 in a generally lengthwise direction relative to the axis 484. The fluid then flows angularly outward through the supply holes 506 from the receptacle 504 to the slots 576 in the pintle 502 as illustrated by arrows 522. In turn, the fluid flows lengthwise through the slots 576, generally annularly through the throat or annular chamber 520 between the sleeve 500 and the pintle 502 as indicated by arrows 524, and annularly outward from the fluid delivery tip assembly 404 as indicated by arrows 530.

In the illustrated embodiment, the fluid flow through the supply holes 506 may be generally angled in a downstream direction relative to the axis 484 as indicated by arrows 522. In addition, as discussed in further detail below, the supply holes 506 may direct the fluid flow in a generally angled radial direction or radial orientation that is offset from the axis 484 to induce a swirling flow within the generally annular chamber 520. The slots 576 may include a plurality of separate axial slots, such as four axial slots disposed across four supply holes 506. However, some embodiments of the slots 576 may include a complete annular or cylindrical shaped recess or slot disposed about the circumference of the pintle 502.

Further downstream, the converging outer surface 572 and the cylindrical passage 568 define a generally diverging annular passage 584 extending downstream from the slots 576. Thus, the fluid flow may expand circumferentially as the pintle 502 changes from discrete slots 576 (e.g., four slots) to a complete annular geometry between the converging outer surface 572 and the cylindrical passage 568. In addition, the fluid flow can expand in a downstream direction due to the converging outer surface 572 of the pintle 502, which generally diverges with respect to the surrounding cylindrical passage 568 of the sleeve 500.

Subsequently, the diverging outer surface 574 and the cylindrical passage 568 define a generally converging annular passage 586 leading to the fluid tip exit 416. In other words, the generally converging annular passage 586 causes the fluid flow to converge in a generally annular manner in a downstream direction toward the fluid tip exit 416. The illustrated fluid tip exit 416 may have a generally ring shaped or annular fluid exit, which creates a generally hollow tapered or conical spray pattern as indicated by the arrows 530. As the fluid flows through the various passages in the fluid delivery tip assembly 404, the diverging passage 584 generally causes a decrease in the fluid velocity, whereas the converging passage 586 causes an increase in the fluid velocity. The various restricted passages, such as the passages 514, the annular gap 518, the supply holes 506, and the recesses or slots 576 also may cause an increase in the fluid velocity due to the restricted cross-sectional area of these various passages. In this manner, the fluid delivery tip assembly 404 may substantially improve the fluid mixing, breakup of particulate, and general turbulence of the fluid flow inside the fluid delivery tip assembly 404 prior to exiting to form a spray, as indicated by arrows 530.

Figure 11:
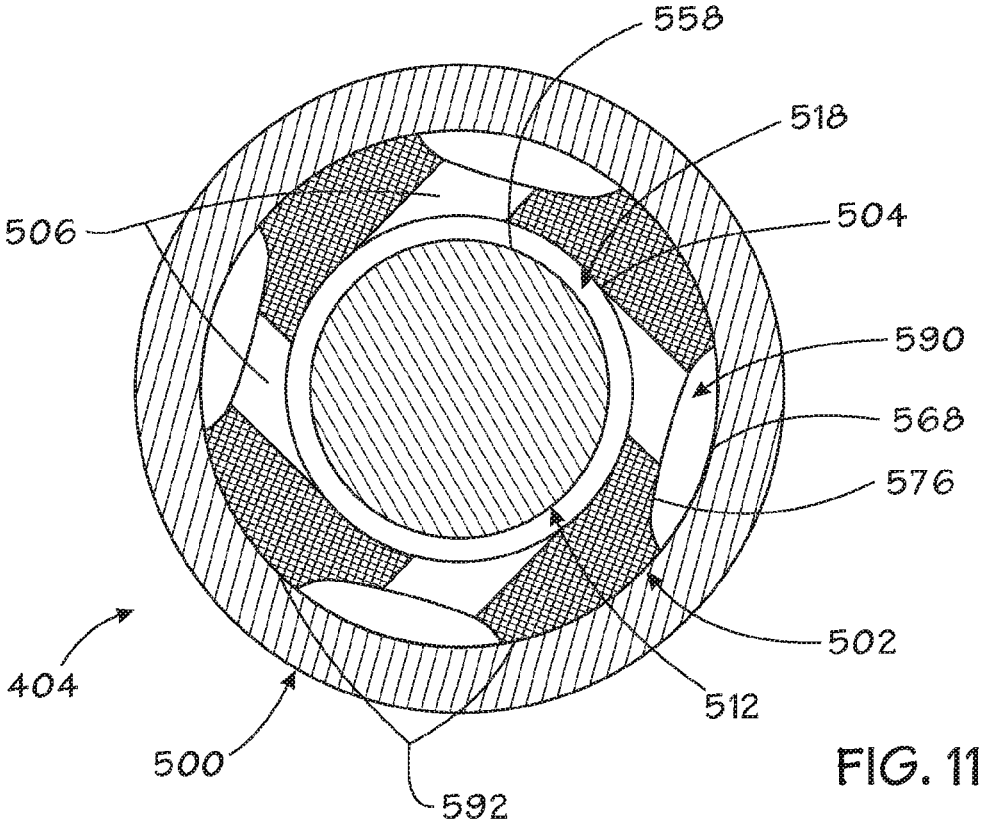
FIG. 11 is a cross-sectional end view of an exemplary pintle disposed within a sleeve of the fluid tip delivery assembly of FIGS. 8-10 in accordance with certain embodiments of the present technique.

FIG. 11 is a cross-sectional end view of an embodiment of the sleeve 500 disposed concentrically about the pintle 502 and the tip portion 512 in the fluid delivery tip assembly 404 as illustrated in FIG. 10. In the illustrated embodiment, the fluid delivery tip assembly 404 includes a set of four supply holes 506 extending through the pintle 502 from the annular gap 518 to a set of four corresponding circumferentially separated axial passages 590. Specifically, the illustrated axial passages 590 are defined by the space between the cylindrical passage 568 in the sleeve 500 and the slots 576 along the cylindrical outer surface 570 of the pintle 502. As discussed above, these four passages 590 extend axially or lengthwise along the axis 484 between the pintle 502 and the sleeve 500. In other embodiments, the pintle 502 may include another number of supply holes 506 and corresponding slots 576, such as 2, 3, 4, 5, 6, 7, 8, 9, 10, or more, thereby defining a corresponding number of axial passages 590. In addition, the pintle 502 includes a set of circumferentially arranged ribs or axial segments 592 between the respective axial passages 590. In other words, the axial segments 592 generally protrude or extend radially outwardly to a greater radius or diameter relative to the corresponding slots 576 along the pintle 502. These axial segments 592 generally have a cylindrical surface mated with the cylindrical passage 568 of the sleeve 500. Again, as mentioned above, the axial segments 592 may be generally press fit within the cylindrical passage 568 of the sleeve 500, thereby securing the pintle 502 in an axially centered or concentric position within the sleeve 500. As further illustrated in FIG. 11, the receptacle 504 of the pintle 502 has a generally cylindrical interior geometry, which is slightly larger than the generally cylindrical surface 558 of the tip portion 512. In this manner, the receptacle 504 and the tip portion 512 define the annular gap 518 to enable fluid flow from the passages 514 in the tip portion 512 to the supply holes 506 in the pintle 502.

Figure 12:
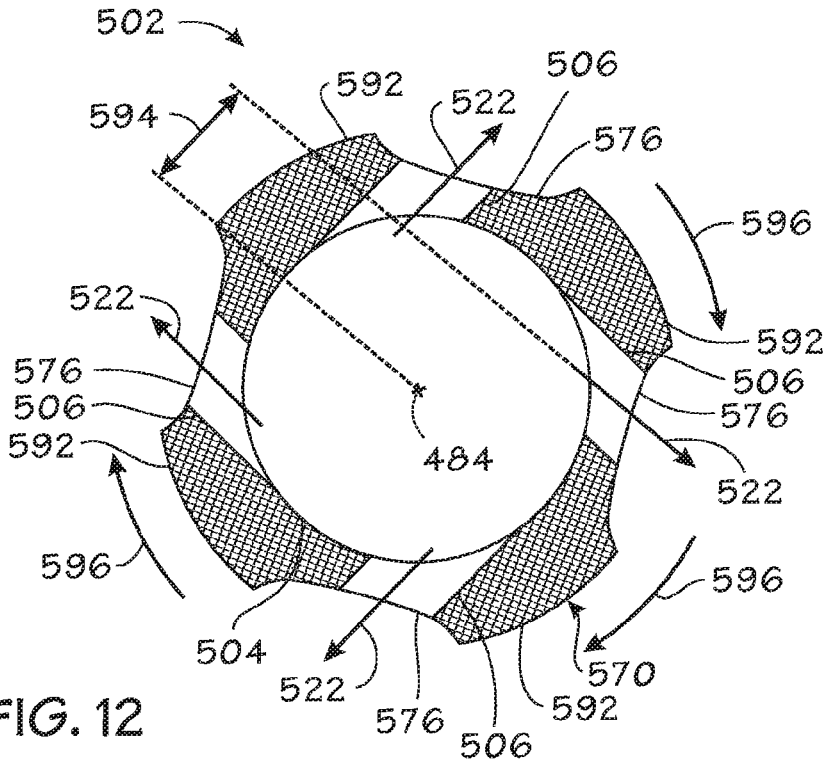
FIG. 12 is a cross-sectional end view of the pintle of FIG. 11 in accordance with certain embodiments of the present technique.

FIG. 12 is a cross-sectional end view of the pintle 502 separate from the sleeve 500 and the nozzle 503 as illustrated in FIG. 11, further illustrating the geometry of the supply holes 506 extending from the receptacle 504 to the slots 576. In the illustrated embodiment, the supply holes 506 are oriented in a generally outward or radial direction relative to the central axis 484 as indicated by arrows 522. As mentioned above, the supply holes 506 are also offset from the axis 484 by a distance 594, thereby inducing a swirling motion or generally rotational motion in the fluid flow as indicated by arrows 596. In addition to the illustrated swirling flow 596, the supply holes 506 may be directed in a generally downstream angular direction as indicated by the arrow 522 in FIGS. 9 and 10. Thus, the supply holes 506 may induce both a forward or downstream motion in the fluid flow as well as the swirling motion as indicated by arrows 522 and 596. In this manner, the fluid flow may initially follow a generally spiraling or helical flow pattern through the annular chamber 520 between the sleeve 500 and the pintle 502 with reference to FIG. 10. In addition to the unique flow patterns discussed above, the swirling flow 596 and potentially spiraling or helical flow pattern may further increase the fluid mixing, breakup of particulate, and general turbulence of the fluid flow within the fluid delivery tip assembly 404 prior to ejection as by arrows 530 in FIGS. 9 and 10.

Figure 13:
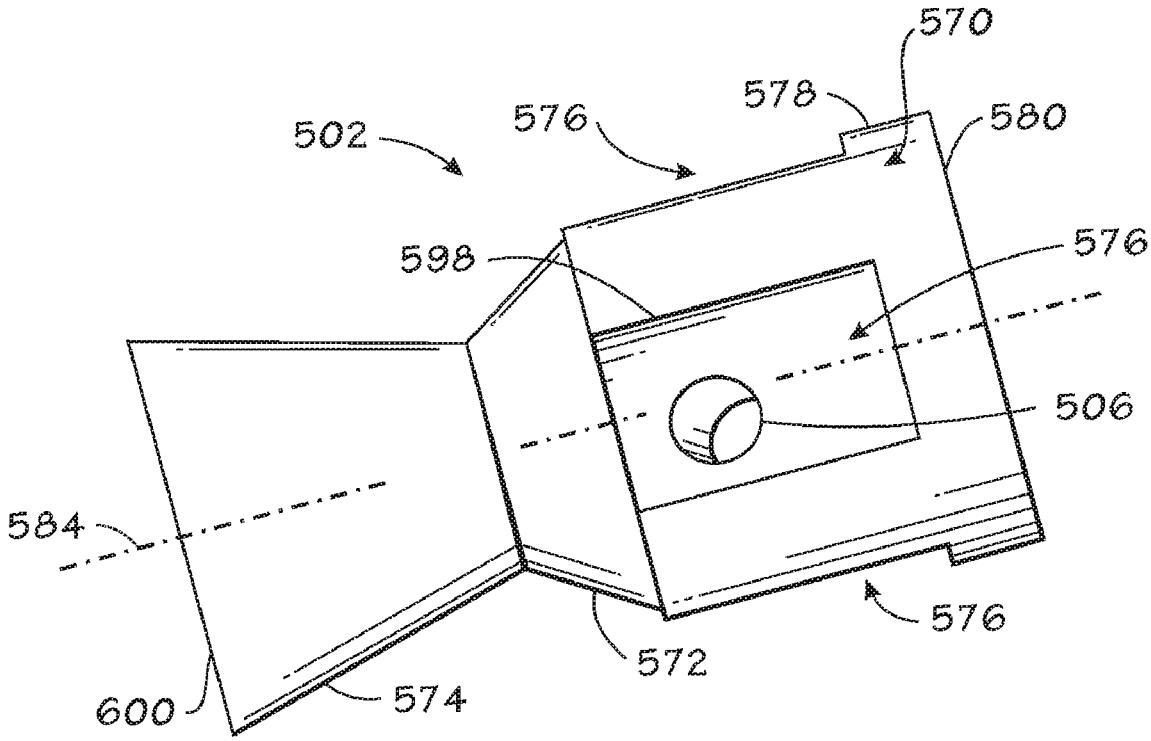
FIG. 13 is a side view of the pintle as illustrated in FIGS. 8-12 in accordance with certain embodiments of the present technique.

FIG. 13 is a side view of an embodiment of the pintle separate from the sleeve 500 and the nozzle 503 as illustrated in FIGS. 10 and 11, further illustrating the set of four recesses or slots 576 across the supply holes 506. As illustrated, each slot 576 has a generally rectangular perimeter 598 surrounding the respective supply hole 506. In addition, the rectangular perimeter 598 of each slot 576 generally begins at the annular flange portion 578 and extends to the converging outer surface 572. As discussed above, the cylindrical outer surface 570 generally extends from the inner side 580 of the pintle 502 to the beginning of the converging outer surface 572 in the space surrounding the rectangular perimeters 598 of the slots 576. Thus, the generally cylindrical surface 570 extends along a substantial portion of the length of the pintle 502 between the inner side 580 and an outer side 600. In this manner, the cylindrical outer surface 570 may generally ensure proper centering of the entire pintle 502 upon press fitting the pintle 502 into the sleeve 500. In the illustrated embodiment, the pintle 502 includes a single converging outer surface 572 and a single diverging outer surface 574. However, in other embodiments, the pintle 502 may include a plurality of diverging and converging outer surfaces. For example, the outer surface of the pintle 502 may alternatingly converge and diverge in a generally zigzagging manner to form alternating conical surfaces along the length of the pintle 502. In this manner, the pintle 502 may further increase the fluid mixing, internal breakup of particulate, and general turbulence of the fluid flow prior to exiting from the fluid delivery tip assembly 404.

Figure 14:
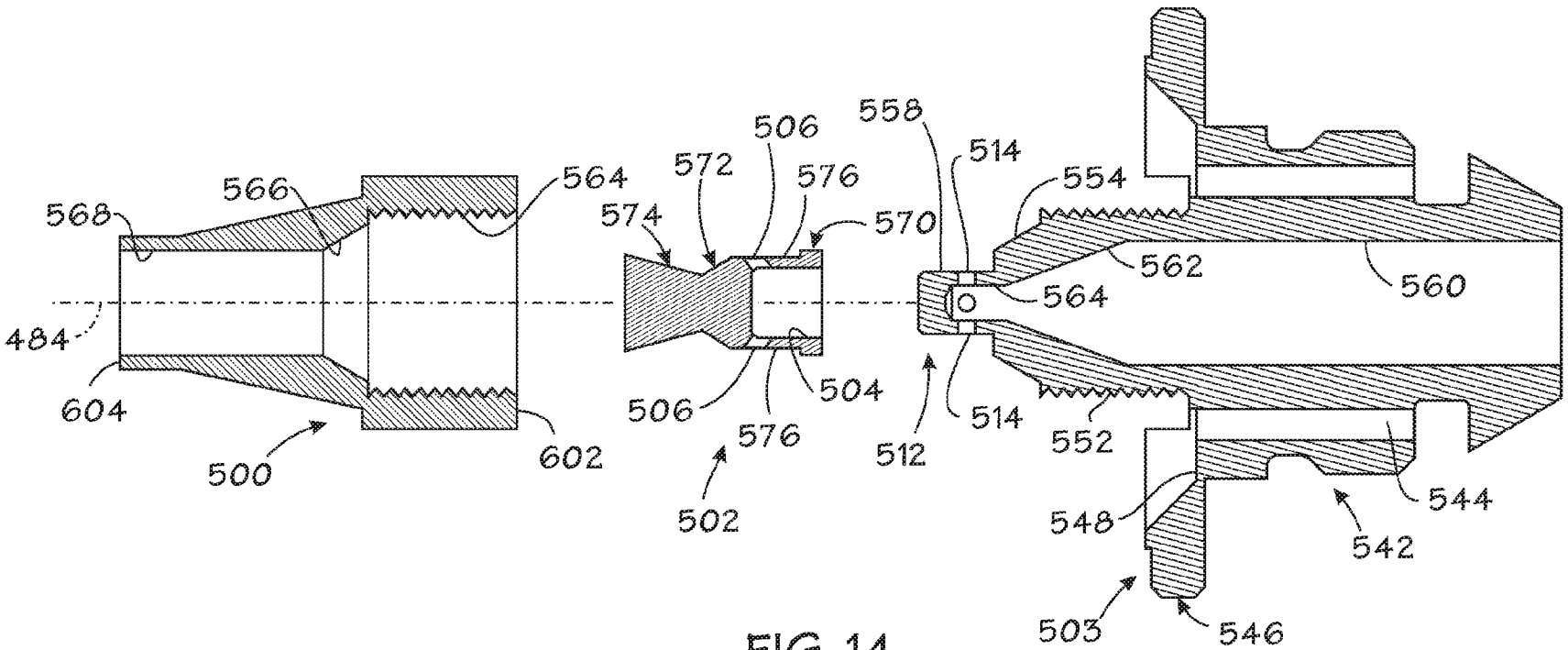
FIG. 14 is an exploded cross-sectional side view of the fluid tip delivery assembly of FIG. 10 in accordance with certain embodiments of the present technique.

FIG. 14 is an exploded cross-sectional view of an embodiment of the fluid delivery tip assembly 404 as illustrated in FIG. 10, further illustrating the sleeve 500, the pintle 502, and a portion of the nozzle 503 exploded from one another. As discussed in detail above, the sleeve 500 may be coupled to the nozzle 503 by engaging the threaded nozzle interface 564 with the corresponding threaded exterior 552. In addition, the pintle 502 can be press fit or generally inserted within the sleeve 500 without any threaded engagement between the sleeve 500 and the pintle 502. In this manner, the pintle 502 becomes substantially or completely centered within the sleeve 500 relative to the axis 484. In other words, the position of the pintle 502 does not become off center by any eccentricities of threads between the sleeve 500 and the pintle 502.

Again, in some embodiments, the pintle 502 may be disposed concentrically within the sleeve 500 prior to coupling the sleeve 500 with the nozzle 503. In other embodiments, the pintle 502 may be partially inserted into the sleeve 500, and then fully driven into the cylindrical passage 568 by threading the sleeve 500 onto the nozzle 503. In other words, the pintle 502 may become compressed between the sleeve 500 and the nozzle 503, such that the threaded engagement between the sleeve 500 and the nozzle 502 progressively drives the pintle 502 lengthwise into the sleeve 500. Accordingly, the cylindrical passage 568 of the sleeve 500 may generally converge in a downstream direction from a first end or inner side 602 to a second end or outer side 604 of the sleeve 500.

With reference to FIGS. 8 and 14, the sleeve 500 and pintle 502 have a generally small geometry relative to the spray tip assembly 400 and the entire spray coating device 12. Thus, the relatively small geometry of these components 500 and 502 may substantially reduce the costs of replacing the sleeve 500 and the pintle 502 due to wear by fluid passing through the fluid delivery tip assembly 404. In addition, the relatively small geometry of the sleeve 500 and the pintle 502 enables easier access, replacement, servicing, or repair in the event of wear or damage, as opposed to disassembling a larger portion of the spray tip assembly 400 and the overall spray coating device 12.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A system, comprising:

a spray device, comprising:

a liquid path leading to a liquid exit;

a valve coupled to the liquid path; and a spray assembly coupled to the liquid path downstream from the valve, wherein the spray assembly comprises:

a sleeve;

a pintle disposed inside the sleeve;

an annular passage between an inner surface of the sleeve and an outer surface of the pintle, wherein the annular passage extends to the liquid exit; and a plurality of swirl grooves disposed substantially along a conical surface in the annular passage.

2. The system of claim 1, wherein the pintle is threadless, and the pintle is press fit into the sleeve.

3. The system of claim 1, wherein the pintle comprises an upstream end, a central recess extending axially into the upstream end, and a plurality of passages extending through the pintle from the central recess to the annular passage.

4. The system of claim 3, wherein the plurality of passages is angled to induce swirl.

5. The system of claim 1, wherein the inner surface of the sleeve comprises an inner cylindrical surface extending to the liquid exit.

6. The system of claim 5, wherein the outer surface of the pintle comprises an outer cylindrical surface press fit into the inner cylindrical surface of the sleeve.

7. The system of claim 6, wherein an upstream end of the pintle comprises outer cylindrical surface.

8. The system of claim 5, wherein the outer surface of the pintle alternatingly decreases and increases in diameter along the inner cylindrical surface of the sleeve.

9. The system of claim 5, wherein the outer surface of the pintle comprises a first conical surface and a second conical surface downstream from the first conical surface, and the first and second conical surfaces are angled differently from one another.

10. The system of claim 1, wherein the plurality of swirl grooves curve about a longitudinal axis of the spray assembly along the conical surface.

11. The system of claim 1, wherein each swirl groove generally diverges relative to a longitudinal axis of the spray assembly in a downstream direction toward the liquid exit along the conical surface.

12. The system of claim 1, wherein the plurality of swirl grooves is disposed on the conical surface along the outer surface of the pintle.

13. The system of claim 12, wherein the conical surface extends to a downstream end of the pintle, and the plurality of swirl grooves extends along the conical surface to the downstream end of the pintle.

14. A system, comprising:

a spray assembly, comprising:

a stationary sleeve;

a stationary pintle disposed inside the stationary sleeve;

an annular liquid passage between an inner surface of the stationary sleeve and an outer surface of the stationary pintle; and a plurality of swirl grooves disposed substantially along a conical surface in the annular liquid passage, wherein plurality of swirl grooves diverge relative to a longitudinal axis of the spray assembly in a downstream direction.

15. The system of claim 14, wherein the outer surface of the stationary pintle comprises an outer cylindrical surface press fit into an inner cylindrical surface of the stationary sleeve, wherein the stationary pintle comprises an upstream end, a central recess extending axially into the upstream end, and a plurality of passages extending through the stationary pintle from the central recess to the annular liquid passage.

16. The system of claim 15, wherein the plurality of passages is angled to induce swirl.

17. The system of claim 14, wherein the inner surface of the stationary sleeve comprises an inner cylindrical surface, and the outer surface of the stationary pintle alternatingly converges and diverges relative to the longitudinal axis within the inner cylindrical surface of the stationary sleeve.

18. The system of claim 14, wherein the outer surface of the stationary pintle comprises the conical surface having the plurality of swirl grooves, the inner surface of the stationary sleeve comprises a cylindrical surface surrounding the plurality of swirl grooves, and the annular liquid passage extends to an annular liquid exit between the stationary sleeve and the stationary pintle.

19. A system, comprising:

a spray assembly, comprising:

a stationary sleeve having an inner surface;

a stationary pintle having an outer surface disposed inside the stationary sleeve, wherein the stationary pintle comprises an upstream end, a central recess extending axially into the upstream end, and a plurality of passages extending through the stationary pintle from the central recess to the outer surface;

an annular liquid passage between the inner and outer surfaces, wherein the annular liquid passage extends to an annular liquid exit; and a plurality of swirl grooves disposed substantially along a conical surface in the annular liquid passage.

20. The system of claim 19, wherein the inner surface of the stationary sleeve comprises an inner cylindrical surface, and the outer surface of the stationary pintle comprises alternatingly converging and diverging conical surfaces within the inner cylindrical surface of the stationary sleeve.

* * * * *